US009591904B2

(12) United States Patent
Park et al.

(10) Patent No.: US 9,591,904 B2
(45) Date of Patent: Mar. 14, 2017

(54) PROTECTING COVER

(71) Applicant: Samsung Electronics Co., Ltd., Suwon-si, Gyeonggi-do (KR)

(72) Inventors: Seon-Keun Park, Seoul (KR); Kwan-Eui Hong, Yongin-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 14/816,801

(22) Filed: Aug. 3, 2015

(65) Prior Publication Data

US 2016/0029760 A1 Feb. 4, 2016

(30) Foreign Application Priority Data

Aug. 1, 2014 (KR) ..... 10-2014-0099277

(51) Int. Cl.
*B65D 85/00* (2006.01)
*A45C 11/00* (2006.01)

(52) U.S. Cl.
CPC ..... *A45C 11/00* (2013.01); *A45C 2011/002* (2013.01); *A45C 2011/003* (2013.01); *A45C 2200/15* (2013.01)

(58) Field of Classification Search
CPC ..... A45C 11/00; A45C 2011/002; A45C 2011/003; H05K 5/03
USPC .... 206/37, 38, 305, 320, 45.2, 45.23, 45.24, 206/45.28, 751, 752; 361/679.55, 679.56, 361/679.59; 455/575.1, 575.8
See application file for complete search history.

(56) References Cited

U.S. PATENT DOCUMENTS 3,769,741 A * 11/1973 Hessler ..... A01K 97/06 206/315.11
8,282,065 B1 * 10/2012 Stone ..... A47B 23/044 206/45.24
8,887,910 B2 * 11/2014 Ashley ..... A45C 11/00 206/320
2004/0226793 A1 * 11/2004 Tilby ..... F41C 33/06 190/125
2008/0302687 A1 * 12/2008 Sirichai ..... A45F 5/02 206/320
2013/0134061 A1 * 5/2013 Wu ..... G06F 1/1626 206/320
2013/0140203 A1 * 6/2013 Chiang ..... G06F 1/1628 206/320
2014/0083883 A1 * 3/2014 Elias ..... G06F 1/1626 206/320
2015/0041341 A1 * 2/2015 Marshall ..... A45C 11/00 206/320

(Continued)

FOREIGN PATENT DOCUMENTS

KR 10-2003-0031250 A 4/2003
KR 10-2012-0038415 A 4/2012

*Primary Examiner* — Luan K Bui
(74) *Attorney, Agent, or Firm* — Jefferson IP Law, LLP

(57) ABSTRACT

A protecting cover is provided. The protecting cover includes a first cover portion which is bendable and to which a first electronic device may be detachably coupled, a second cover portion which is bendably connected with the first cover portion and to which a second electronic device may be detachably coupled, and a third cover portion which is bendably connected with the first cover portion, in which the first cover portion, the second cover portion, and the third cover portion may be used as a cradle by being bent.

13 Claims, 9 Drawing Sheets

(56) References Cited

U.S. PATENT DOCUMENTS

2015/0160696 A1 6/2015 Lauder et al.

* cited by examiner

PROTECTING COVER

CROSS-REFERENCE TO RELATED APPLICATION(S)

This application claims the benefit under 35 U.S.C. §119 (a) of a Korean patent application filed on Aug. 1, 2014 in the Korean Intellectual Property Office and assigned Serial No. 10-2014-0099277, the entire disclosure of which is hereby incorporated by reference.

TECHNICAL FIELD

The present disclosure relates to a protecting cover. More particularly, the present disclosure relates to a protecting cover for an electronic device.

BACKGROUND

Recently, cellular phones, Moving Picture Experts Group phase 1 or phase 2 (MPEG-1 or MPEG-2) audio layer 3 (MP3) players, portable multimedia players (PMPs), tablet personal computers (PCs), Galaxy Tabs™, iPads™, electronic-book terminals, and other various electronic devices have been provided to users. Based on their portability, the users may enjoy various contents while carrying those electronic devices with them.

To keep up with the rapid development of information and communication technologies and to meet various demands from users, electronic devices have various functions such as audio and video play functions, a game play function, a camera function, a schedule management function, a dictionary function, and so forth as well as their original functions, and even provide an information search function and a new application add function.

The electronic devices may also be used for various tasks such as word processing, social media networking, and games, by means of a user touching a screen. However, errors or other limitations may occur when a document is made by touches on the screen, revealing a need for a keyboard.

For example, the user holds the electronic device by hand or puts the electronic device into the pocket or bag and uses the electronic device while on the move, during which the electronic device may be lost or damaged. To protect the electronic device, the electronic device is usually provided with a separate protecting cover mounted on the electronic device.

According to the related art, a protecting cover having an electronic device mounted thereon may be used as a standing cradle and a typing cradle. However, when the protecting cover is used as the typing cradle, the user may have a difficulty in making a touch input because of having to directly touch the screen of the electronic device. For example, when making a document by touching the screen of the electronic device, the user needs to touch the screen several times. That is, there is a limitation in touch inputs for tasks needing a keyboard, such as the task of making a document.

In other words, users have used electronic devices for various tasks such as word processing, social media networking, and games, and these tasks are performed by touching the screens of the electronic devices, having a physical limitation in touch inputs and thus imposing a need for a keyboard.

Therefore, a need exists for a device allowing an electronic device having a large screen and a keyboard to be received and at the same time, to be carried in a protecting cover.

The above information is presented as background information only to assist with an understanding of the present disclosure. No determination has been made, and no assertion is made, as to whether any of the above might be applicable as prior art with regard to the present disclosure.

SUMMARY

Aspects of the present disclosure are to address at least the above-mentioned problems and/or disadvantages and to provide at least the advantages described below. Accordingly, an aspect of the present disclosure is to provide a protecting cover having a plurality of cover portions which have an electronic device and a keyboard together mounted thereon and which are also used as a support with bends of the plurality of cover portions, improving and expanding the use of a product with the keyboard and enhancing portability and convenience of the keyboard.

Another aspect of the present disclosure is to provide a protecting cover having a component (for example, a coupling portion, a magnetic force portion, a Velcro® portion, an attachment/removal member, and so forth) for locking and fastening or unlocking an electronic device and a keyboard to or from the protecting cover depending on whether the electronic device and the keyboard are attached to or removed from the protecting cover, thereby facilitating attachment or removal of the electronic device and the keyboard to or from the protecting cover.

In accordance with an aspect of the present disclosure, a protecting cover is provided. The protecting cover includes a first cover portion which is bendable and to which a first electronic device may be detachably coupled, a second cover portion which is bendably connected with the first cover portion and to which a second electronic device may be detachably coupled, and a third cover portion which is bendably connected with the first cover portion, in which the first cover portion, the second cover portion, and the third cover portion may be used as a cradle by being bent.

In accordance with another aspect of the present disclosure, a protecting cover is provided. The protecting cover includes a first cover portion that is bendable and includes a front surface on which a first electronic device may be detachably coupled, a second cover portion that is bendably connected with the first cover portion and includes a front surface of which a second electronic device may be detachably coupled, and a third cover portion that is bendably connected with the first cover portion, in which the first cover portion, the second cover portion, and the third cover portion may be used as a cradle by being bent.

Other aspects, advantages, and salient features of the disclosure will become apparent to those skilled in the art from the following detailed description, which, taken in conjunction with the annexed drawings, discloses various embodiments of the present disclosure.

BRIEF DESCRIPTION OF THE DRAWINGS

The above and other aspects, features, and advantages of certain embodiments of the present disclosure will be more apparent from the following description taken in conjunction with the accompanying drawings, in which.

Throughout the drawings, like reference numerals will be understood to refer to like parts, components, and structures.

DETAILED DESCRIPTION

Figure 1:
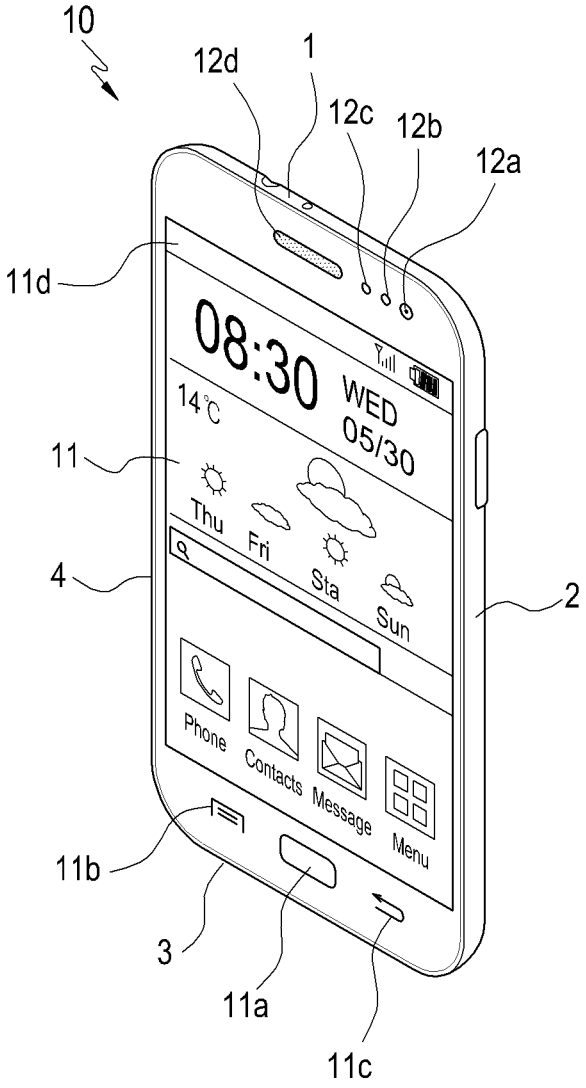
FIG. 1 is a perspective view showing a front surface of a first electronic device attachable to and removable from a protecting cover according to various embodiments of the present disclosure.

The following description with reference to the accompanying drawings is provided to assist in a comprehensive understanding of various embodiments of the present disclosure as defined by the claims and their equivalents. It includes various specific details to assist in that understanding but these are to be regarded as merely exemplary. Accordingly, those of ordinary skill in the art will recognize that various changes and modifications of the various embodiments described herein can be made without departing from the scope and spirit of the present disclosure. In addition, descriptions of well-known functions and constructions may be omitted for clarity and conciseness.

The terms and words used in the following description and claims are not limited to the bibliographical meanings, but, are merely used by the inventor to enable a clear and consistent understanding of the present disclosure. Accordingly, it should be apparent to those skilled in the art that the following description of various embodiments of the present disclosure, is provided for illustration purpose only and not for the purpose of limiting the present disclosure as defined by the appended claims and their equivalents.

The terms and words used in the following description and claims are not limited to the bibliographical meanings, but, are merely used by the inventor to enable a clear and consistent understanding of the present disclosure. Accordingly, it should be apparent to those skilled in the art that the following description of various embodiments of the present disclosure is provided for illustration purpose only and not for the purpose of limiting the present disclosure as defined by the appended claims and their equivalents.

It is to be understood that the singular forms "a," "an," and "the" include plural referents unless the context clearly dictates otherwise. Thus, for example, reference to "a component surface" includes reference to one or more of such surfaces.

While terms including ordinal numbers, such as "first" and "second", or the like, may be used to describe various components, such components are not limited to the above terms. The above terms are used only to distinguish one component from another. For example, a first component may be referred to as a second component without departing from the scope of rights of the present disclosure, and likewise a second component may be referred to as a first component.

Herein, an electronic device attached to and removed from a protecting cover according to various embodiments of the present disclosure will be described. First, applications of the electronic device according to an embodiment of the present disclosure includes any mobile communication terminal operating based on a communication protocol corresponding to various communication systems and any information communication device, multimedia device, an application device thereof such as a video phone, an electronic book (e-book) reader, a laptop personal computer (PC), a netbook computer, a personal digital assistant (PDA), a portable multimedia player (PMP), a Moving Picture Experts Group phase 1 or phase 2 (MPEG-1 or MPEG-2) audio layer 3 (MP3) player, mobile medical equipment, an electronic bracelet, an electronic necklace, an electronic appcessory, a camera, a wearable device (for example, a head-mounted device (HMD) such as electronic glasses), an electronic cloth, an electronic bracelet, an electronic necklace, an electronic appcessory, an electronic tattoo, and a smart watch.

According to various embodiments of the present disclosure, the electronic device may be a smart home appliance. The electronic device may include, for example, a television (TV), a digital versatile disc (DVD) player, audio equipment, a refrigerator, an air conditioner, a vacuum cleaner, an oven, a microwave oven, a laundry machine, an air cleaner, a set-top box, a TV box (for example, Samsung HomeSync™, Apple TV™, or Google TV™), a game console, an electronic dictionary, an electronic key, a camcorder, and an electronic frame.

According to various embodiments of the present disclosure, the electronic device may include at least one of various medical equipment (for example, a magnetic resonance angiography (MRA), magnetic resonance imaging (MRI), computed tomography (CT), an imaging device, or an ultrasonic device), a navigation system, a global positioning system (GPS) receiver, an event data recorder (EDR), a flight data recorder (FDR), a vehicle infotainment device, electronic equipment for ships (for example, navigation system and gyro compass for ships), avionics, a security device, a vehicle head unit, an industrial or home robot, an automatic teller's machine (ATM), or a point of sales (POS).

According to various embodiments of the present disclosure, the electronic device may include a part of a furniture or building/structure, an electronic board, an electronic signature receiving device, a projector, and various measuring instruments (for example, a water, electricity, gas, or electric wave measuring device).

An electronic device according to various embodiments of the present disclosure may be a combination of one or more of the above-described various devices. The electronic device according to various embodiments of the present disclosure may be a flexible device. Furthermore, it would be obvious to a person skilled in the art that the electronic device according to various embodiments of the present disclosure are not limited to the above-described various devices.

Figure 2:
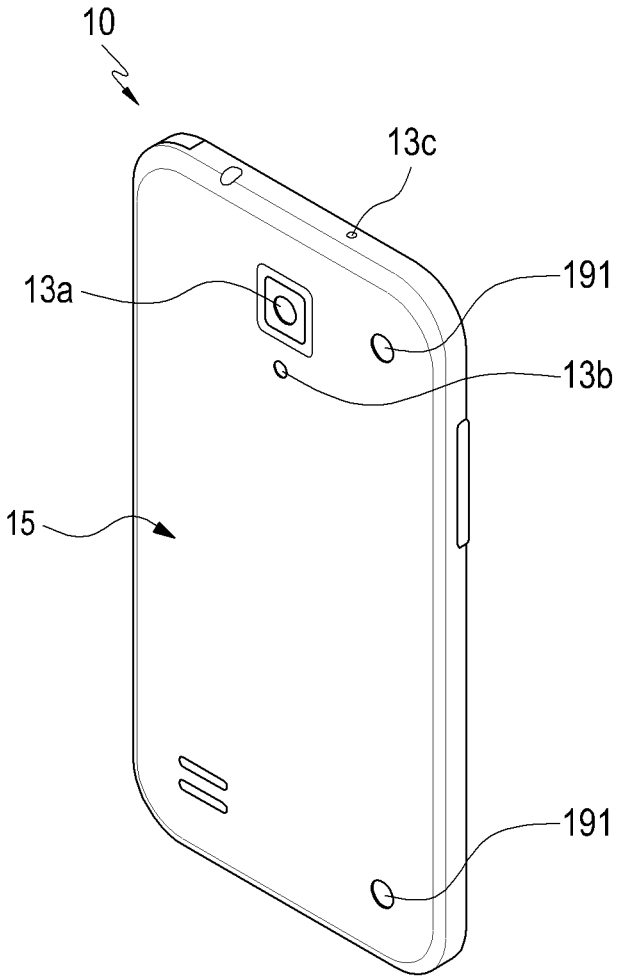
FIG. 2 is a perspective view showing a rear surface of the first electronic device attachable to and removable from a protecting cover according to various embodiments of the present disclosure.

FIG. 1 is a perspective view showing a front surface of an electronic device attachable to and removable from a protecting cover according to various embodiments of the present disclosure. FIG. 2 is a perspective view showing a rear surface of the electronic device attachable to and removable from a protecting cover according to various embodiments of the present disclosure. The electronic device may be a smartphone or a tablet PC.

Referring to FIGS. 1 and 2, a configuration of an electronic device such as a smartphone will be described.

As shown in FIGS. 1 and 2, a touch screen 11 is disposed in the center of a front surface of an electronic device 10. The electronic device 10 includes a top side 1, a first side 2, a bottom side 3 and a second side 4. The touch screen 11 is formed to occupy most of the front surface of the electronic device 10. FIG. 1 shows an example in which a main home screen is displayed on the touch screen 11. The main home screen is an initial screen displayed on the touch screen 11 when the electronic device 10 is powered on. When the electronic device 10 has different home screens of several pages, the main home screen is the first home screen among the home screens of the several pages. Shortcut icons for executing frequently used applications, a main menu change key, time, weather, and so forth are displayed on the home screen. The main menu change key may be used to display a menu screen on the touch screen 11. A status bar 11*d* indicating a state, such as a battery charge state, a strength of a received signal, and a current time, is formed in an upper portion of the touch screen 11. A home button 11*a*, a menu button 11*b*, and a back button 11*c* are disposed in a lower portion of the touch screen 11.

The home button 11*a* is intended to display the main home screen on the touch screen 11. For example, when any home screen, which is different from the main home screen, or a menu screen is displayed on the touch screen 11, the main home screen is displayed on the touch screen 11 upon selection of the home button 11*a*. If the home button 11*a* is selected during execution of applications on the touch screen 11, the main home screen is displayed on the touch screen 11. The home button 11*a* is used to display recently used applications or a task manager on the touch screen 11. The menu button 11*b* provides a connection menu that is displayed on the touch screen 11. The connection menu includes, for example, a widget add menu, a background change menu, a search menu, an edit menu, and an environment-setting menu. The back button 11*c* is used to display a screen that was displayed immediately before the currently executed screen or to terminate the most recently used application.

According to various embodiments of the present disclosure, a first camera 12*a*, an illumination sensor 12*b*, a proximity sensor 12*c*, and a speaker 12*d* are disposed on an edge of the front surface of the electronic device 10. The second camera 13*a*, the flash 13*b*, and the speaker 13*c* are disposed on a rear surface of the electronic device 10. If a battery pack is configured to be removable from the electronic device 10, the bottom surface of the electronic device 10 may be a removable battery cover 15.

The electronic device to be described below may include a first electronic device and a second electronic device, and the first electronic device may include any one of a laptop computer, a netbook, a smartphone, a tablet PC, a Galaxy Tab™, and an iPad™, and the second electronic device may include a keyboard. In the current embodiment, a description will be made using the tablet PC as an example.

As described below, a protecting cover protects the first electronic device 10 and the second electronic device 20. The protecting cover will be described using a protecting cover as an example, without being limited to the example. That is, the protecting cover may be applied variously if it protects the first electronic device 10 and the second electronic device 20. In various embodiments of the present disclosure, the protecting cover will be described as being applied to surfaces of the first electronic device 10 and the second electronic device 20.

A structure of a protecting cover for protecting the first electronic device 10 and the second electronic device 20 will be described with reference to FIGS. 3 and 4.

Figure 3:
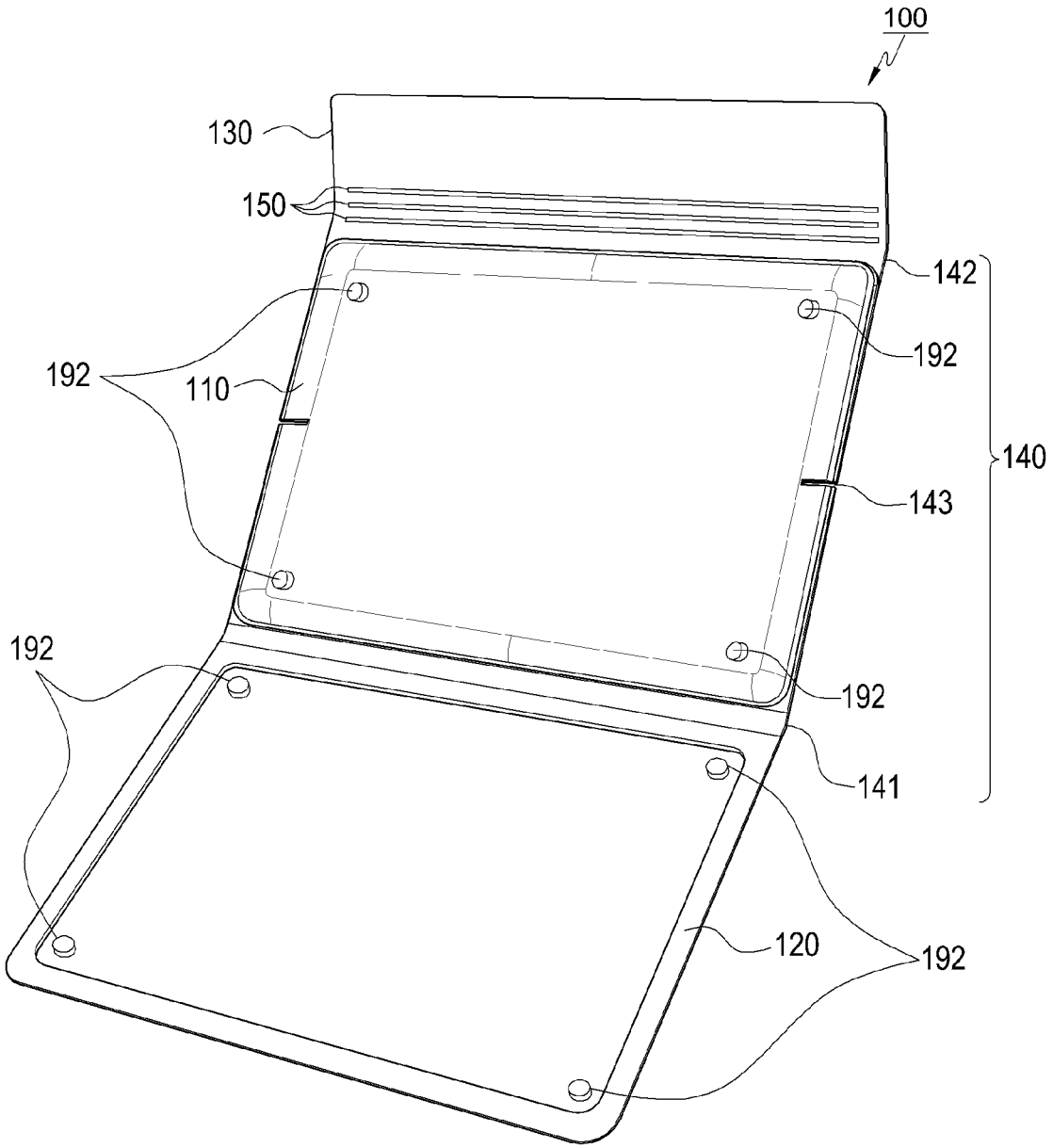
FIG. 3 is a perspective view showing a structure of a protecting cover according to various embodiments of the present disclosure.
Figure 4:
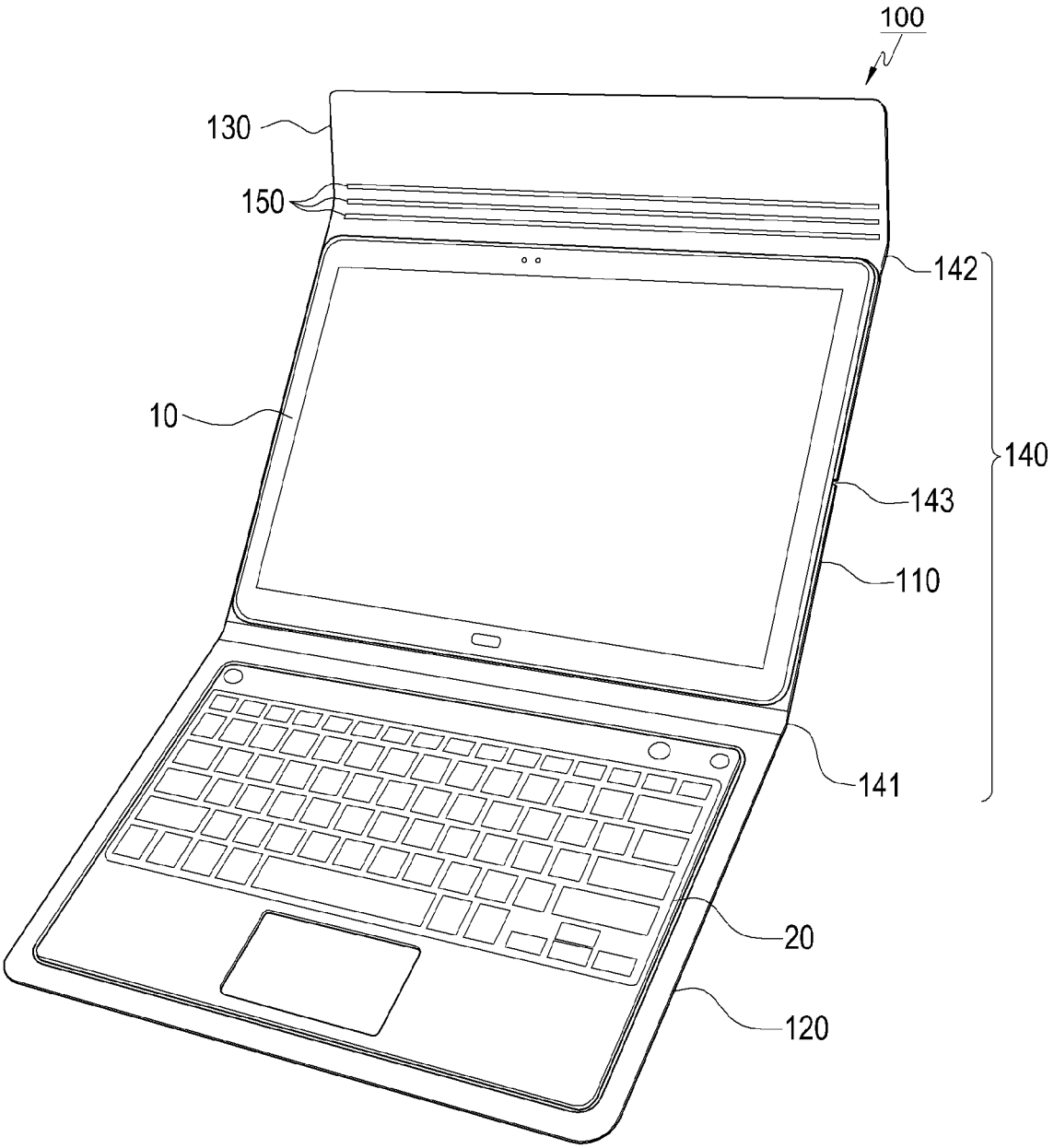
FIG. 4 is a perspective view showing a state where a first electronic device and a second electronic device are mounted on a protecting cover according to various embodiments of the present disclosure.
Figure 5:
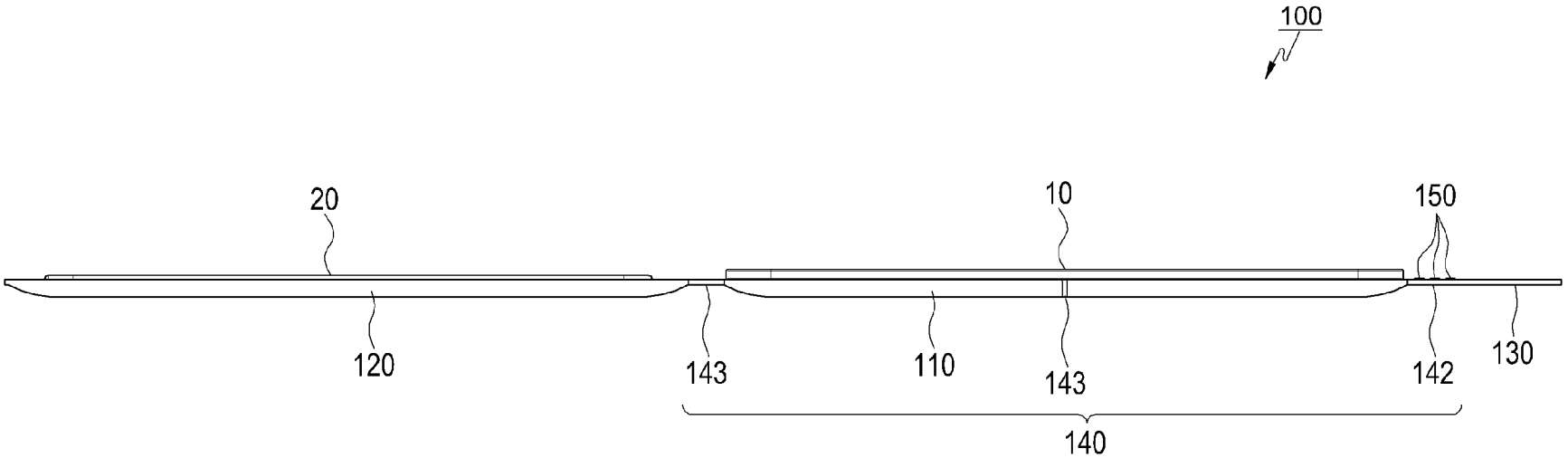
FIG. 5 is a side view showing a state where the first electronic device and the second electronic device are mounted on a protecting cover according to various embodiments of the present disclosure.

FIG. 3 is a perspective view showing a structure of a protecting cover according to various embodiments of the present disclosure, FIG. 4 is a perspective view showing a state where a first electronic device and a second electronic device are mounted on the protecting cover according to various embodiments of the present disclosure, and FIG. 5 is a side view showing a state where the first electronic device and the second electronic device are mounted on the protecting cover according to various embodiments of the present disclosure.

Referring to FIGS. 3-5, the protecting cover may include a first cover portion 110, a second cover portion 120, and a third cover portion 130. A rear surface of the first electronic device 10 is positioned on a front surface of the first cover portion 110 which is bent for use of the first cover portion 110 as a cradle. A rear surface of the second electronic device 20 is positioned on a front surface of the second cover portion 120 which is bendably connected with the first cover portion 110. The third cover portion 130 is bendably connected to the first cover portion 110 for use of the first cover portion 110 and the second cover portion 120 as a cradle according to bends of the first cover portion 110 and the second cover portion 120.

Moreover, between the first cover portion 110 and the third cover 130 may include at least one support 150 to support the first cover portion 110, the second cover portion 120, and the third cover portion 130 for use as a cradle. The support 150 may be formed of a rubber material. The support 150 may include multiple protrusion portions to protrude from the second cover portion 120. In the current embodiment of the present disclosure, the support 150 will be described as being formed of a rubber material, but the support 150 is not limited to the rubber material. That is, the support 150 may use various materials if it may be fixed and supported on a bottom surface.

In this way, by using the first cover portion 110 including the first electronic device 10 having the touch screen and the second cover portion 120 including the second electronic device 20 having the keyboard as a cradle according to bends of the first cover portion 110 and the second cover portion 120 and by providing the third cover portion 130 supporting the cradle, various tasks may be performed using the keyboard when the protecting cover is used as a standing cradle and a typing cradle, improving and expanding the use of a protecting cover 100 with the keyboard and enhancing portability and convenience of the keyboard.

Referring to FIG. 5, between the first cover portion 110, the second cover portion 120, and the third portion 130, at least one bend portion 140 is provided to bendably connect the first, second, and third cover portions 110, 120, and 130. The at least one bend portion 140 may include a first bend portion 141, a second bend portion 142, and a third bend portion 143. The first bend portion 141 is provided between the first cover portion 110 and the second cover portion 120 to bend the first cover portion 110 and the second cover portion 120. The second bend portion 142 is provided between the second cover portion 120 and the third cover portion 130 to bend the second cover portion 120 and the third cover portion 130. The third bend portion 143 is provided in the first cover portion 110 to bend the first cover portion 110.

That is, when the first cover portion 110, the second cover portion 120, and the third cover portion 130 are used as a standing cradle and a typing cradle, the first cover portion 110 is pivoted from the second cover portion 120 at an incline by the first bend portion 141, and a center portion of the first cover portion 110 is bent by the third bend portion 143 included in the first cover portion 110. The third cover portion 130, provided at one end of the first cover portion 110, is bent by the second bend portion 142 and is supported by a surface, such as on the ground. Between the first cover portion 110 and the third cover 130 may include at least one support 150 to use the first cover portion 110 and the second cover portion 120 as a cradle, and thus the third cover portion 130 is supported using the support 150 and at the same time, uses the first cover portion 110 and the second cover portion 120 as the support 150.

When the first cover portion 110, the second cover portion 120, and the third cover portion 130 are not used as a cradle, the first cover portion 110 is pivoted by the third bend portion 143 provided in the center portion of the second cover portion 120 to confront the rear surface of the first electronic device 10, the first cover portion 110 is pivoted by the first bend portion 141 to confront the front surface of the second cover portion 120, and the third cover portion 130 is pivoted by the second bend portion 142 to confront the rear surface of the second cover portion 120.

The first cover portion 110 and the second cover portion 120 may include at least one coupling portion, at least one magnetic force portion (not shown), at least one Velcro® portion (not shown) and attachment/removal members (not shown) to attach or remove the first electronic device 10 and the second electronic device 20 to or from the first cover portion 110 and the second cover portion 120.

The at least one coupling portion may include at least one hook portion 192 that is detachably coupled to at least one attachment/removal portion 191 of the first electronic device 10 and/or the second electronic device 20. For example, the at least one hook portion 192 may be provided in the protecting cover 100 to be attached to or removed from the at least one attachment/removal portion 191 provided on the rear surfaces of the first electronic device 10 and the second electronic device 20.

The at least one attachment/removal portion 191 is provided in a position corresponding to the at least one hook portion 192, and may be provided on the rear surface of the first electronic device 10 (e.g., the removable battery cover 15) and the second electronic device 20 to lock and fasten or unlock the at least one hook portion 192 depending on attachment or removal of the at least one hook portion 192 to or from the at least one attachment/removal portion 191.

The at least one magnetic force portion (not shown) may include at least one first magnet portion and at least one second magnet portion (not shown). The at least one first magnet portion is provided on a rear surface of the first electronic device 10 and a rear surface of the second electronic device 20 to confront the at least one second magnet portion and to be attached or removed by the magnetic force. The at least one second magnet portion is provided on the first cover portion 110 and the second cover portion 120 to confront the at least one first magnet portion and to attach or remove the first electronic device 10 and the second electronic device 20 from the protecting cover 100 by the magnetic force.

When the at least one second magnet portion includes a permanent magnet, the at least one first magnet portion may include a metallic plate. On the other hand, when the at least one first magnet portion includes a permanent magnet, the at least one second magnet portion may include a metallic plate. Both the at least one first magnet portion and the at least one second magnet portion may include a permanent magnet.

That is, the at least one first magnet portion may include a metallic plate or a permanent magnet depending on a choice, and likewise, the at least one second magnet portion may also include a metallic plate or a permanent magnet depending on a choice. In other words, either the at least one first magnet portion or the at least one second magnet portion (not shown) may include a magnet or a metallic plate to attach and come into contact with each other by the magnetic force.

The at least one attachment/removal member (not shown) may include an attachment/removal hook portion for attachment to or removal from an outer circumference of the first electronic device 10 (e.g., the top side 1, the first side 2, the bottom side 3, or the second side 4) and the second electronic device 20.

The first cover portion 110 and the second cover portion 120 may include anyone of a keyboard, a cradle, a battery cover, a protecting cover, and a flip cover. Herein, the first cover portion 110 and the second portion 120 may also be applied to other devices than the above-listed devices.

Referring to FIG. 3 to describe assembly of the protecting cover 100, the protecting cover 100 may include the first cover portion 110, the second cover portion 120, and the third cover portion 130. The first bend portion 141 is provided between the first cover portion 110 and the second cover portion 120, and the second bend portion 142 is provided between the first cover portion 110 and the third cover portion 130.

The first electronic device 10 having the touch screen is mounted on the first cover portion 110. The at least one attachment/removal portion 191 provided on the first electronic device 10 is coupled by insertion into the at least one hook portion 192 provided on the first cover portion 110. The at least one attachment/removal portion 191 provided on the second electronic device 20 having the keyboard is coupled by insertion into the at least one hook portion 192 provided on the second cover portion 120.

In this state, an operation of the protecting cover 100 will be described in more detail.

Figure 6:
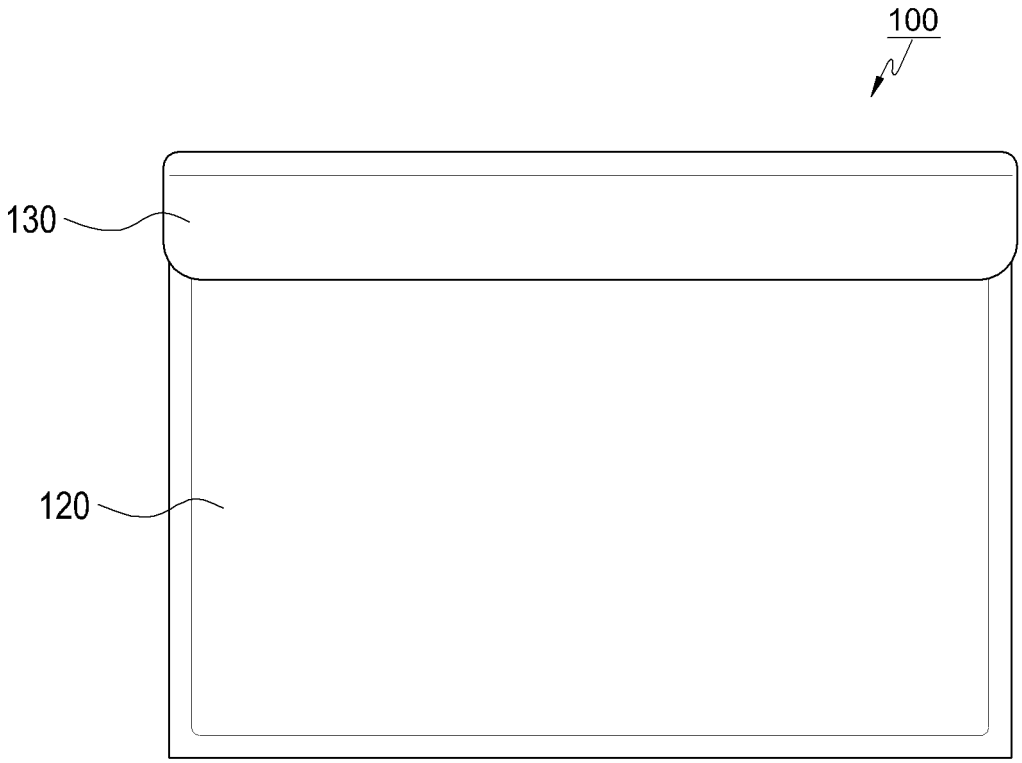
FIG. 6 is a front view showing a closed state in which first and second electronic devices are attached to a protecting cover according to various embodiments of the present disclosure.

FIG. 6 is a front view showing a closed state in which first and second electronic devices and are attached to a protecting cover according to various embodiments of the present disclosure.

Figure 7:
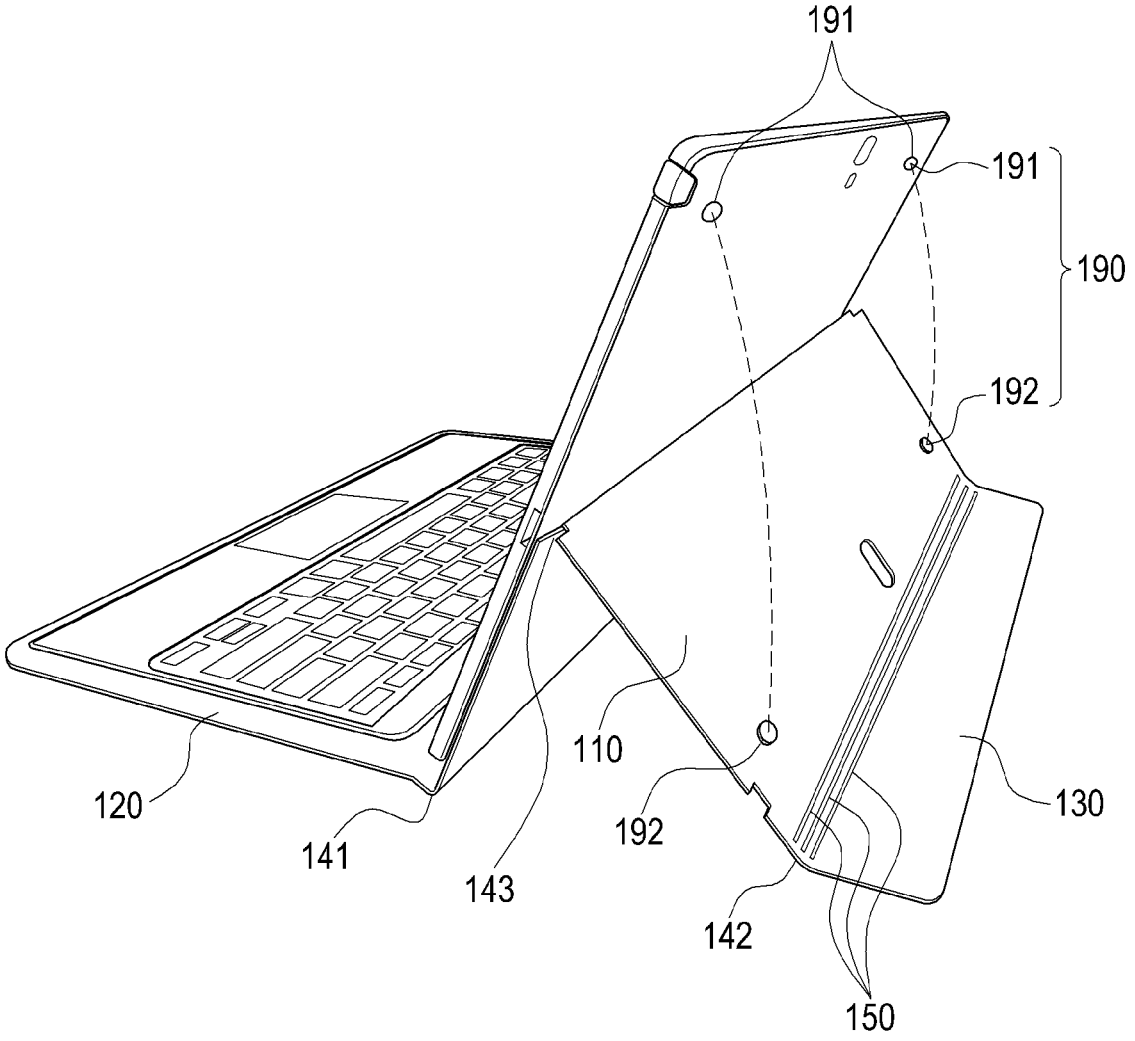
FIG. 7 is a perspective view showing a support provided in a third cover portion of a protecting cover according to various embodiments of the present disclosure.

FIG. 7 is a perspective view showing a support provided in a third cover portion of a protecting cover according to various embodiments of the present disclosure.

Figure 8:
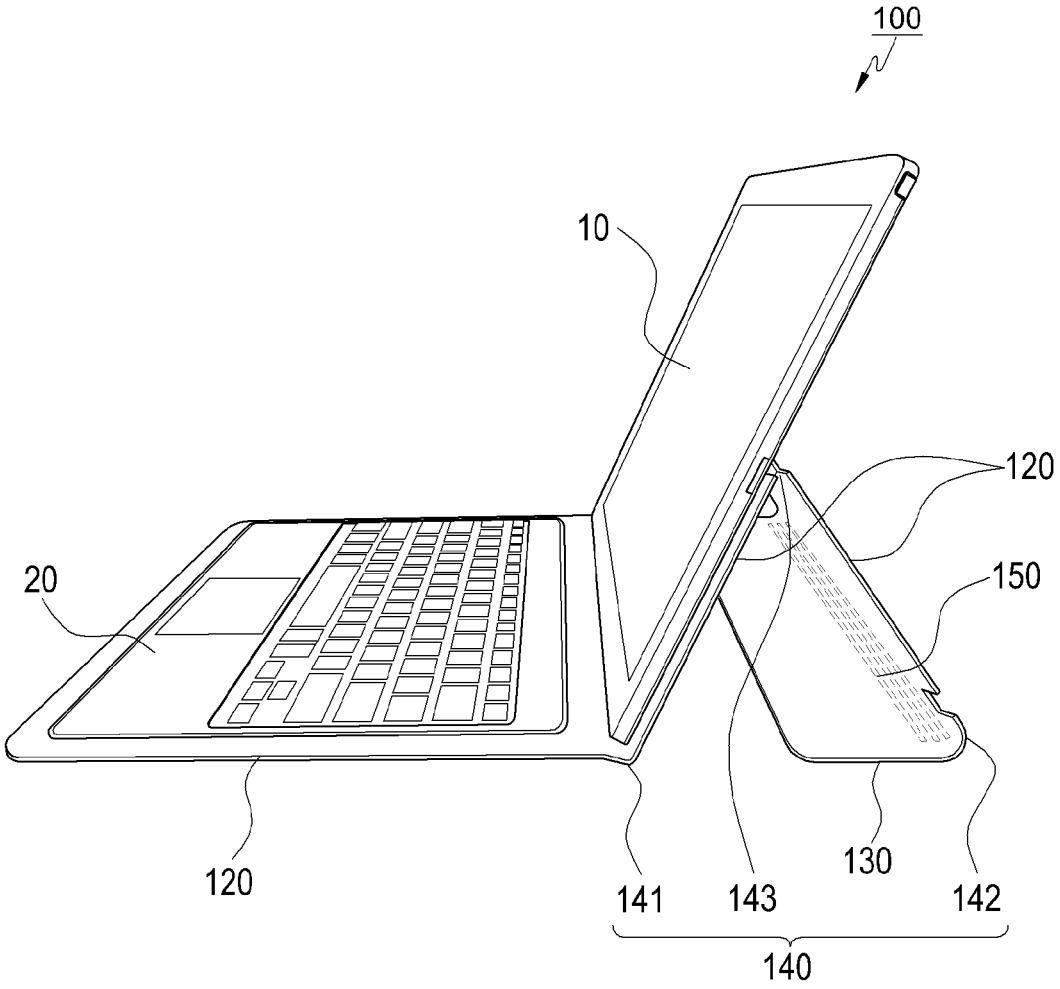
FIG. 8 is a perspective view showing use of a protecting cover as a standing cradle and a typing cradle according to various embodiments of the present disclosure.

FIG. 8 is a perspective view showing use of a protecting cover as a standing cradle and a typing cradle according to various embodiments of the present disclosure.

Referring to FIG. 6, the third cover portion 130 confronting the front surface of the second cover portion 120 is unfolded by being pivoted by the second bend portion 142. The second cover portion 120 is unfolded by being pivoted away from the first cover portion 110 by the first bend portion 141.

Thus, the first electronic device 10 having the touch screen, provided in the first cover portion 110, is open and the keyboard of the second electronic device 20, provided in the second cover portion 120, is also open. Next, the first cover portion 110 is bent by being pivoted by the third bend portion 143 provided in the first cover portion 110, and the center portion of the first cover portion 110 is bent by being pivoted by the second bend portion 142.

Referring to FIGS. 7 and 8, the third cover portion 130 confronts the ground and at the same time, is supported on the ground. That is, the rear surface of the second cover portion 120 confronts the ground, and the third cover portion 130 is bent by the second bend portion 142 and thus is supported on the ground.

The first electronic device 10 provided in the first cover portion 110 is cradled at an incline, and the second cover portion 120 cradles the second electronic device 20 having the keyboard in a position confronting the ground.

As described with reference to FIG. 7, since between the first cover portion 110 and the third cover 130 includes the at least one support 150 to support the first cover portion 110 and the second cover portion 120 for use of the first cover portion 110 and the second cover portion 120 as a cradle, the at least one support 150 is supported on the ground to continue using the first cover portion 110 and the second cover portion 120 as a cradle.

In this state, the protecting cover 100 is used as the standing cradle and the typing cradle with the first cover portion 110, the second cover portion 120, and the third cover portion 130.

Moreover, a user may watch various moving images through the first electronic device 10 having the touch screen.

For a protecting cover of the related art (not shown), when a user does typing in a cradle state of an electronic device (not shown), the user has to do an input operation by directly touching the screen of the electronic device repetitively several times, making the touch input operation difficult.

To overcome the above and other weaknesses, in various embodiments of the present disclosure, the first electronic device 10 having the touch screen and the second electronic device 20 having the keyboard are provided in the first cover portion 110 and the second cover portion 120 of the protecting cover (100 shown in FIGS. 3 and 4), allowing the user to perform various tasks through the screen and the keyboard of the electronic device and thus improving and expanding the use of the protecting cover with the keyboard and enhancing portability and convenience of the keyboard.

Herein, the various tasks may include word processing, social media networking, and games, and other various tasks performed through the screen and the keyboard of the electronic device.

Figure 9:
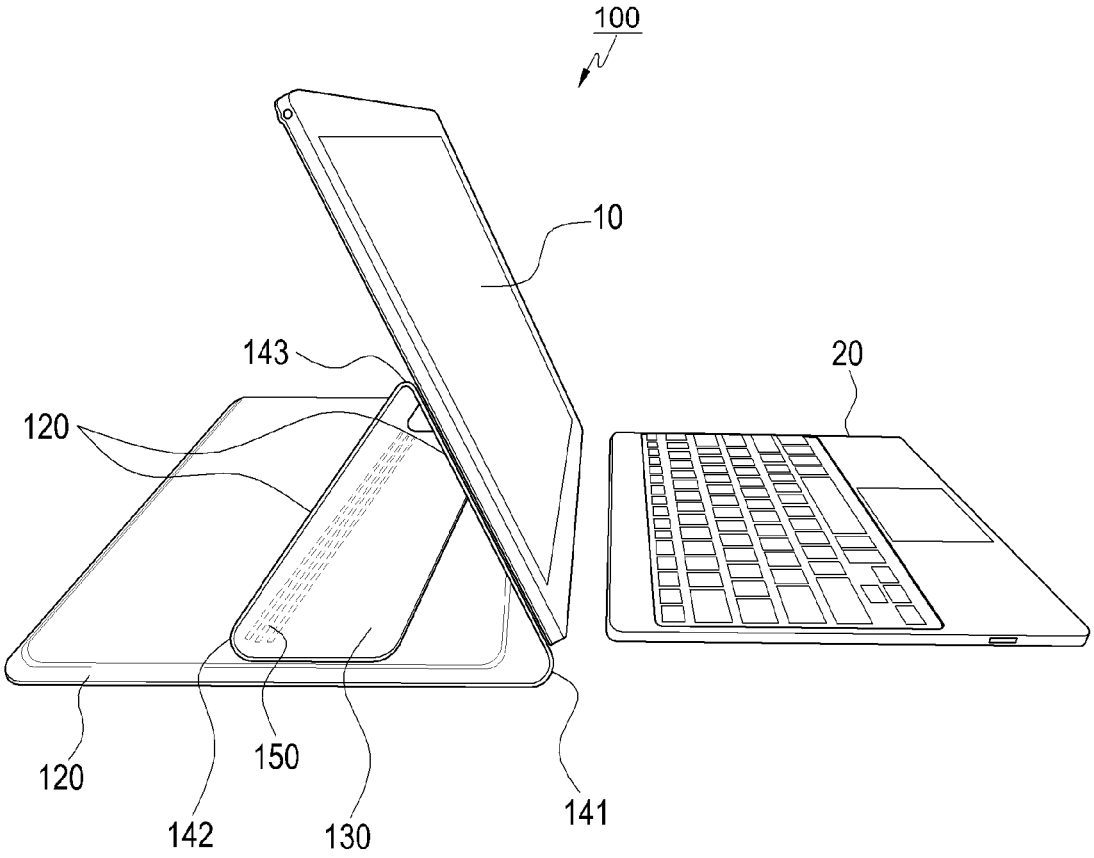
FIG. 9 is a perspective view showing another example of use of a protecting cover as a standing cradle and a typing cradle according to various embodiments of the present disclosure.

FIG. 9 is a perspective view showing another example of use of a protecting cover as a standing cradle and a typing cradle according to various embodiments of the present disclosure.

Referring to FIG. 9, according to an embodiment of the present disclosure in which the protecting cover 100 is used, to use the first cover portion 110, the second cover portion 120, and the third cover portion 130 as a cradle, the keyboard mounted on the second cover portion 120 is separated.

In this state, the first cover portion 110 having the first electronic device 10 mounted therein is pivoted at an incline from the second cover portion 120 by the first bend portion 141, and at the same time, the front surface of the second cover portion 120 confronts the ground.

The center portion of the first cover portion 110 is bent by the third bend portion 143 provided in the first cover portion 110. The third cover portion 130 provided in one end of the first cover portion 110 is bent by the second bend portion 142 and at the same time, is placed and supported on the rear surface of the second cover portion 120.

That is, the at least one support 150 is supported on the rear surface of the second cover portion 120, and the separated keyboard of the second electronic device 120 is used in front of the first electronic device 10 cradled at an incline.

The keyboard may include the at least one hook portion 192 attached to or removed from the at least one attachment/removal portion 191 provided in the second cover portion 120, and thus before being used, the keyboard is separated from the attachment/removal portion 191 of the second cover portion 120 through the hook portion 192 of the keyboard. When the keyboard is not used, the hook portion 192 of the keyboard is attached back to the attachment/removal portion 191 of the second cover portion 120.

According to various embodiments of the present disclosure, multiple cover portions are provided, which have an electronic device and a keyboard mounted therein and at the same time, are used as a standing cradle and a typing cradle by bend portions, allowing a user to use the keyboard for various tasks with the electronic device without having to touch a screen of the electronic device, and thus improving and expanding the use of a product with the keyboard and enhancing portability and convenience of the keyboard.

Moreover, a component (for example, a coupling portion, a magnetic force portion, a Velcro® portion, an attachment/removal member, and so forth) is provided to lock and fasten or unlock the electronic device and the keyboard to or from the protecting cover depending on whether the electronic device and the keyboard are attached to or removed from the protecting cover, thereby facilitating attachment or removal of the electronic device and the keyboard to or from the protecting cover.

Other effects that may be obtained or expected from the embodiments of the present disclosure are explicitly or implicitly disclosed in the detailed description of the embodiment of the present disclosure. For example, various effects expected from the embodiments of the present disclosure have been disclosed in the detailed description of the present disclosure.

While the present disclosure has been shown and described with reference to various embodiments thereof, it will be understood by those skilled in the art that various changes in form and details may be made therein without departing from the spirit and scope of the present disclosure as defined by the appended claims and their equivalents.

What is claimed is:

1. A protecting cover comprising:

a first cover portion which is bendable and to which an electronic device comprising a touch screen may be detachably coupled;

a second cover portion which is bendably connected with the first cover portion and to which a keyboard may be detachably coupled; and a third cover portion which is bendably connected with the first cover portion, wherein the first cover portion, the second cover portion, and the third cover portion may be used as a cradle by being bent, wherein between the first cover portion and the third cover portion, at least one support is provided, which supports the first cover portion, the second cover portion, and the third cover portion for use of the first cover portion, the second cover portion, and the third cover portion as the cradle, and wherein the at least one support comprises a rubber material and multiple protrusion portions protruding between the first cover portion and the third cover portion.

2. The protecting cover of claim 1, wherein the electronic device comprising a touch screen comprises one of a netbook, a smartphone, and a tablet personal computer.

3. A protecting cover comprising:

a first cover portion that is bendable and includes a front surface on which an electronic device comprising a touch screen may be detachably coupled;

a second cover portion that is bendably connected with the first cover portion and includes a front surface of which a keyboard may be detachably coupled; and a third cover portion that is bendably connected with the first cover portion, wherein the first cover portion, the second cover portion, and the third cover portion may be used as a cradle by being bent, wherein between the first cover portion and the third cover portion, at least one support is provided, which supports the first cover portion, the second cover portion, and the third cover portion for use of the first cover portion, the second cover portion, and the third cover portion as the cradle, and wherein the at least one support comprises a rubber material and multiple protrusion portions protruding between the first cover portion and the third cover portion.

4. The protecting cover of claim 3, wherein the electronic device comprising the touch screen comprises one of a netbook, a smartphone, and a tablet personal computer.

5. The protecting cover of claim 3, further comprising:

at least one bend portion bendably connecting the first cover portion, the second cover portion, and the third cover portion between the first cover portion, the second cover portion, and the third cover portion.

6. The protecting cover of claim 5, wherein the at least one bend portion comprises:

a first bend portion provided between the first cover portion and the second cover portion to bend the first cover portion and the second cover portion;

a second bend portion provided between the first cover portion and the third cover portion to bend the third cover portion; and a third bend portion provided in the first cover portion to bend the first cover portion.

7. The protecting cover of claim 3, wherein the first cover portion and the second cover portion comprise at least one coupling portion, at least one magnetic force portion, and at least one Velcro® and attachment/removal member for attachment and removal of the electronic device comprising the touch screen and the keyboard.

8. The protecting cover of claim 7, wherein the at least one coupling portion comprises:

at least one hook portion provided in the protecting cover; and at least one attachment and removal portion provided on a rear surface of the electronic device comprising the touch screen and a rear surface of the keyboard in positions corresponding to the at least one hook portion to lock and fasten or unlock the at least one hook portion according to attachment or removal of the at least one hook portion.

9. The protecting cover of claim 7, wherein the at least one magnetic force portion comprises:

at least one first magnet portion provided on a rear surface of the electronic device comprising the touch screen and a rear surface of the keyboard; and at least one second magnet portion provided on the first cover portion and the second cover portion to confront the at least one first magnet portion and to attach or remove the electronic device comprising the touch screen and the keyboard by a magnetic force.

10. The protecting cover of claim 7, wherein the at least one attachment or removal member comprises at least one attachment or removal hook portion attached to or removed from an outer circumference of the electronic device comprising the touch screen or an outer circumference of the keyboard.

11. The protecting cover of claim 3, wherein the first cover portion and the second cover portion comprise one of the cradle, a battery cover, a protecting cover, and a flip cover.

12. The protecting cover of claim 6, wherein, when the first cover portion, the second cover portion, and the third cover portion are used as the cradle, the first cover portion is pivoted from the second cover portion at an inclined by the first bend portion, a center portion of the first cover portion is bent by a third bend portion provided in the first cover portion, and the third cover portion provided in an end of the first cover portion is bent by the second bend portion and is cradled by being supported on a surface.

13. The protecting cover of claim 12, wherein, when the first cover portion, the second cover portion, and the third cover portion are used as the cradle, the first cover portion is pivoted from the second cover portion at the incline inclined by the first bend portion, a front surface of the second cover portion confronts a surface, a center portion of the first cover portion is bent by a third bend portion provided in the first cover portion, and the third cover portion provided in an end of the first cover portion is bent by the second bend portion and is placed and supported on a rear surface of the second cover portion.

* * * * *